US007274343B2

(12) United States Patent
Kim et al.

(10) Patent No.: US 7,274,343 B2
(45) Date of Patent: Sep. 25, 2007

(54) PLASMA DISPLAY PANEL AND APPARATUS AND METHOD FOR DRIVING THE SAME

(75) Inventors: Jun-Hyung Kim, Asan (KR); Jin-Sung Kim, Cheonan (KR); Myeong-Seob So, Cheonan (KR); Nam-Sung Jung, Yongin (KR)

(73) Assignee: Samsung SDI Co., Ltd., Suwon-si (KR)

( * ) Notice: Subject to any disclaimer, the term of this patent is extended or adjusted under 35 U.S.C. 154(b) by 822 days.

(21) Appl. No.: 10/445,274

(22) Filed: May 23, 2003

(65) Prior Publication Data

US 2004/0046756 A1 Mar. 11, 2004

(30) Foreign Application Priority Data

Sep. 10, 2002 (KR) ..... 10-2002-0054585

(51) Int. Cl.
*G09G 3/10* (2006.01)
*G09G 3/28* (2006.01)

(52) U.S. Cl. ..... 345/62; 345/60; 315/169.1; 315/169.4

(58) Field of Classification Search ..... 345/60–100, 345/204–214; 315/169.1–169.4; 257/668, 257/684

See application file for complete search history.

(56) References Cited

U.S. PATENT DOCUMENTS

| | | | | |
|---|---|---|---|---|
| 4,866,349 | A | 9/1989 | Weber et al. | |
| 5,081,400 | A | 1/1992 | Weber et al. | |
| 5,467,210 | A | 11/1995 | Kishigami | |
| 6,646,387 | B2 * | 11/2003 | Chae et al. | 345/76 |
| 6,727,659 | B2 * | 4/2004 | Kim et al. | 345/60 |
| 2001/0033009 | A1 * | 10/2001 | Inoue et al. | 257/668 |
| 2003/0020152 | A1 * | 1/2003 | Inoue et al. | 257/684 |
| 2003/0057854 | A1 * | 3/2003 | Roh | 315/169.3 |
| 2003/0071578 | A1 | 4/2003 | Lee et al. | |
| 2003/0160569 | A1 * | 8/2003 | Kim et al. | 315/169.1 |
| 2003/0222591 | A1 | 12/2003 | Kim et al. | |

FOREIGN PATENT DOCUMENTS

| | | | |
|---|---|---|---|
| CN | 1206896 | A | 2/1999 |
| EP | 0 902 412 | A1 | 3/1999 |
| EP | 1 018 722 | A1 | 7/2000 |
| EP | 1 160 756 | A1 | 12/2001 |

OTHER PUBLICATIONS

Chinese Patent Abstract for Publication No. CN 1206896 A; Date of publication of application Feb. 3, 1999, in the name of Gan-Chol Chong et al.

European Search Report for Application No. 03090172.2, dated Dec. 15, 2004, in the name of Samsung SDI Co., Ltd.

* cited by examiner

*Primary Examiner*—David L. Lewis
(74) *Attorney, Agent, or Firm*—Christie, Parker & Hale, LLP

(57) ABSTRACT

A PDP address driver circuit includes: an inductor coupled to a conductive pattern. A first current applier applyies a current of a first direction to the inductor and the conductive pattern while sustaining a panel capacitor at an address voltage. A discharger generates a resonance between the inductor and the panel capacitor to discharge the panel capacitor to 0V, while the current of the first direction flows to the inductor and the conductive pattern. A second current applier applyies a current of a second direction to the inductor and the conductive pattern while sustaining the panel capacitor at 0V. A charger generates a resonance between the inductor and the panel capacitor to charge the panel capacitor to the address voltage, while the current of the second direction flows to the inductor and the conductive pattern.

31 Claims, 12 Drawing Sheets

PLASMA DISPLAY PANEL AND APPARATUS AND METHOD FOR DRIVING THE SAME

CROSS REFERENCE TO RELATED APPLICATION

This application claims priority to and the benefit of Korean Patent Application No. 2002-0054585 filed on Sep. 10, 2002 in the Korean Intellectual Property Office, the content of which is incorporated herein by reference.

BACKGROUND OF THE INVENTION (a) Field of the Invention

The present invention relates to a plasma display panel (PDP). More specifically, the present invention relates to an address driver circuit for applying an address voltage.

(b) Description of the Related Art

In recent years, flat panel displays such as a liquid crystal display (LCD), a field emission display (FED), a PDP, and the like have been actively developed. The PDP is advantageous over the other flat panel displays in regard to its high luminance, high luminous efficiency, and wide view angle, and accordingly, it is favorable for making a large-scale screen of more than 40 inches as a substitute for the conventional cathode ray tube (CRT).

The PDP is a flat panel display that uses plasma generated by gas discharge to display characters or images and includes, according to its size, more than several scores to millions of pixels arranged in a matrix pattern. Such a PDP is classified into a direct current (DC) type and an alternating current (AC) type according to its discharge cell structure and the waveform of the driving voltage applied thereto.

The DC-type PDP has electrodes exposed to a discharge space, allowing a DC to flow through the discharge space while voltage is applied, and hence requires resistors for limiting the current. The AC-type PDP has electrodes covered with a dielectric layer that naturally forms a capacitance component that limits the current and protects the electrodes from the impact of ions during a discharge. Thus the AC-type PDP is superior to the DC-type PDP in regard to long lifetime.

The AC type-PDP has scan and sustain electrodes and address electrodes. The scan and sustain electrodes are formed in parallel with each other on one side of the PDP, and the address electrodes are formed on the other side of the PDP and are perpendicular to the scan and sustain electrodes. The sustain electrodes are formed in correspondence to the scan electrodes with one terminal thereof commonly coupled to one terminal of each scan electrode.

Typically, the driving method of the AC-type PDP is sequentially composed of a reset step, an addressing step, a sustain discharge step, and an erase step.

In the reset step, the state of each cell is initialized in order to readily perform an addressing operation on the cell. In the addressing step, an address voltage is applied to accumulate wall charges on selected "on"-state cells and other "on"-state cells (i.e., addressed cells) for selecting "off"-state cells on the panel. In the sustain step, a sustain discharge voltage pulse is applied so as to cause a discharge that actually displays an image on the addressed cells. In the erase step, the wall charges on the cells are erased to end the sustain discharge.

In the AC-type PDP, the discharge spaces formed between the scan and sustain electrodes and between the address electrode side and the scan/sustain electrode side act as a capacitive load (hereinafter referred to as "panel capacitor") so that capacitance exists on the panel. Due to the capacitance of the panel capacitor, a reactive power is required in addition to the addressing power in order to apply a waveform for an addressing operation. Typically, the address driver circuit for a PDP includes a power recovery circuit for recovering the reactive power and reusing it. The power recovery circuits are suggested in U.S. Pat. Nos. 4,866,349 and 5,081,400 by L. F. Weber.

With the conventional power recovery circuit mounted on an address buffer board, a conductive output pattern running in the transverse direction of the address buffer board may cause a parasitic inductance component. More specifically, a plurality of address driving ICs are required for driving the address electrodes, because all the address electrodes cannot be coupled to a single address driving IC. By using one power recovery circuit for the plural address driving ICs, the parasitic inductance component is possibly formed on the output pattern in which the address driving ICs are coupled to the address buffer board. The parasitic inductance component causes an extreme distortion on the address driving waveform. Namely, an undesired pulse rise may occur in the rise/drop interval of the address driving waveform because of the parasitic inductance component.

SUMMARY OF THE INVENTION

In accordance with the present invention a power recovery circuit is provided for recovering a reactive power and reusing it, and minimizing the effect of a parasitic inductance component present in an address driver circuit. The present invention stores energy in both an inductor and a parasitic inductance component and uses the stored energy and an LC resonance for charging/discharging a panel capacitor.

In one aspect of the present invention, there is provided an apparatus for driving a PDP, which applies a voltage to a panel capacitor that is coupled on a conductive pattern formed lengthwise. The apparatus includes an inductor coupled to one terminal of the conductive pattern. First and second switches are coupled to the inductor, and operated to charge and discharge the panel capacitor to first and second voltages, respectively. A third switch is coupled between another terminal of the conductive pattern and a first power source for supplying the first voltage, and is operated to generate a current of a first direction flowing to the conductive pattern and the inductor. A fourth switch is coupled between the other terminal of the conductive pattern and a second power source for supplying the second voltage, and is operated to generate a current of a second direction flowing to the inductor and the conductive pattern, the second direction being opposite to the first direction. A power line is coupled to the first and second switches and supplies a voltage having a value between the first and second voltages. The panel capacitor is discharged to the second voltage by a resonance between the inductor and the panel capacitor while the current of the first direction is flowing. The panel capacitor is charged to the first voltage by a resonance between the inductor and the panel capacitor while the current of the second direction is flowing.

In another aspect of the present invention, there is provided an apparatus for driving a plasma display panel, which receives first and second voltages from first and second power sources, respectively, and applies a voltage to a panel capacitor coupled on a conductive pattern formed length wise. The apparatus includes a power line for supplying a voltage having a value between the first and second voltages. An inductor has one terminal thereof coupled to one terminal of the conductive pattern. A first current path is formed to make a current of a first direction flow to the inductor and the conductive pattern, when another terminal of the conductive pattern is coupled to the second power source. A second current path is formed to charge the panel capacitor to the first voltage, when a resonance between the inductor and the panel capacitor is generated while the current of the first direction is flowing. A third current path is formed to recover the current of the first direction remaining in the inductor and the conductive pattern, while the panel capacity is sustained at the first voltage. A fourth current path is formed to make a current of a second direction flow to the conductive pattern and the inductor, when the other terminal of the conductive pattern is coupled to the first power source, the second direction being opposite to the first direction. A fifth current path is formed to discharge the panel capacitor to the second voltage, when a resonance between the inductor and the panel capacitor is formed while the current of the second direction is flowing. A sixth current path is formed to recover the current of the second direction remaining in the inductor and the conductive pattern, while the panel capacitor is sustained at the second voltage.

In further another aspect of the present invention, there is provided a method for driving a plasma display panel, which receives first and second voltages from first and second power sources, respectively, and applies a voltage to a panel capacitor coupled on a conductive pattern formed lengthwise. A current of a first direction is applied to the conductive pattern and an inductor is coupled to one terminal of the conductive pattern. A resonance is generated between the panel capacitor and the inductor to charge the panel capacitor to the first voltage, while the current of the first direction is flowing to the conductive pattern and the inductor. The current remaining in the inductor and the conductive pattern is recovered while sustaining the panel capacitor at the first voltage. A current of a second direction is applied to the inductor and the conductive pattern, the second direction being opposite to the first direction. A resonance is generated between the panel capacitor and the inductor to discharge the panel capacitor to the second voltage, while the current of the second direction is flowing to the inductor and the conductive pattern. The current remaining in the inductor and the conductive pattern is recovered while sustaining the panel capacitor at the second voltage.

In still another aspect of the present invention, there is provided a plasma display panel apparatus. A plasma panel includes a plurality of address electrodes, a plurality of scan and sustain electrodes arranged in pairs and parallel with one another, and a panel capacitor formed among the address, scan, and sustain electrodes. A driver circuit supplies a driving signal to the scan, sustain, and address electrodes. The driver circuit includes: a conductive pattern formed lengthwise and coupled to one of the address, scan, and sustain electrodes; an inductor coupled to one terminal of the conductive pattern; a first current injecting means coupled to the other terminal of the conductive pattern and applying a current of a first direction to the inductor and the conductive pattern while sustaining the panel capacitor at a first voltage; a discharging means for generating a resonance between the inductor and the panel capacitor to discharge the panel capacitor to a second voltage, while the current of the first direction is flowing to the inductor and the conductive pattern by way of the first current injecting means; a second current injecting means for applying a current of a second direction to the inductor and the conductive pattern while sustaining the panel capacitor at a second voltage, the second direction being opposite to the first direction; and a charging means for generating a resonance between the inductor and the panel capacitor to charge the panel capacitor to the first voltage, while the current of the second direction is flowing to the inductor and the conductive pattern by way of the second current injecting means.

In still a further aspect of the present invention, there is provided another plasma display panel apparatus. A plasma panel includes a first substrate, a plurality of address electrodes formed on the first substrate, a second substrate being opposite to the first substrate, and a plurality of scan and sustain electrodes formed on the second substrate and arranged in pairs and parallel with one another. A sash base is provided opposite to the plasma display panel and includes an address buffer board for transferring a driving signal to the address electrodes, and a scan and sustain driver board for transferring the driving signal to the scan and sustain electrodes.

The address buffer board includes: a printed circuit board; an output pattern formed lengthwise on one-side of the printed circuit board and coupled to the address electrodes; an inductor formed on the printed circuit board and coupled to one terminal of the output pattern; first and second switches formed on the printed circuit board and coupled to the inductor; and third and fourth switches formed on the printed circuit board and coupled to the other terminal of the output pattern.

In embodiments of the apparatus and method for driving a plasma display panel or the plasma display panel apparatus according to the present invention, the currents of the first and second directions include a freewheeling current, a current formed by a voltage difference, or both.

In the case where a resonance is formed between the inductor and the panel capacitor, a resonance can also be generated between a parasitic inductance component present in the conductive pattern and the panel capacitor.

DETAILED DESCRIPTION

Hereinafter, a description will be given as to a PDP and its driving apparatus and method according to embodiments of the present invention.

Figure 1:
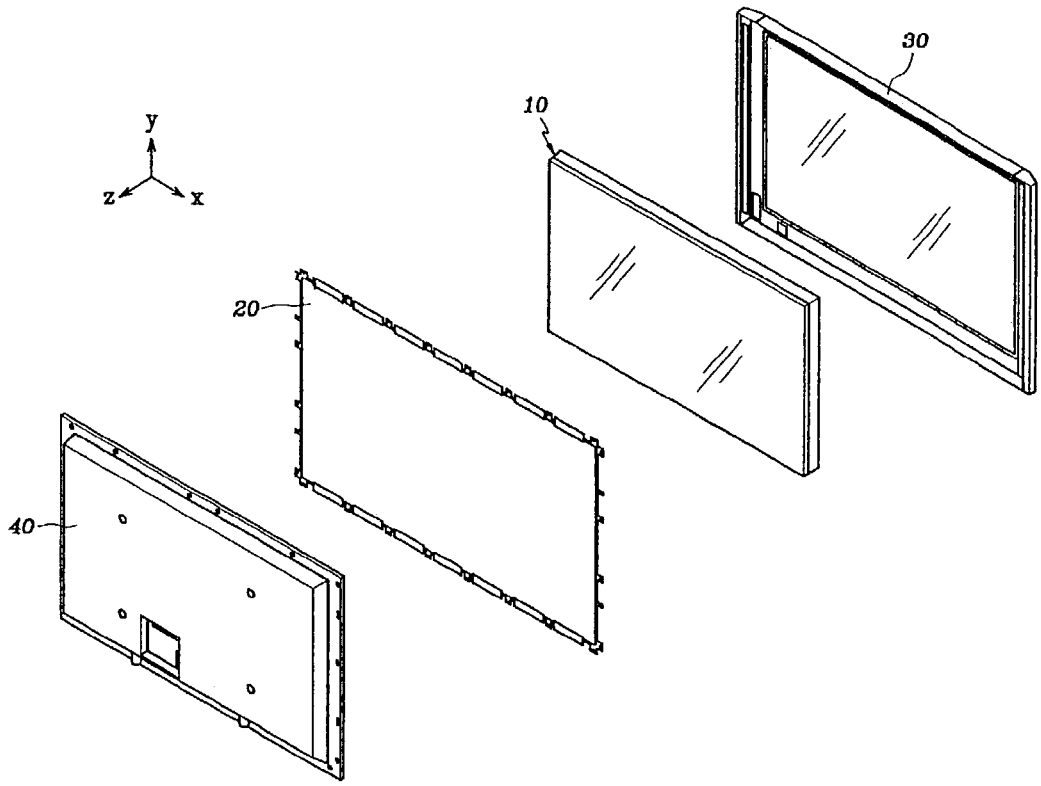
FIG. 1 is an exploded perspective of a PDP apparatus according to an embodiment of the present invention.
Figure 2:
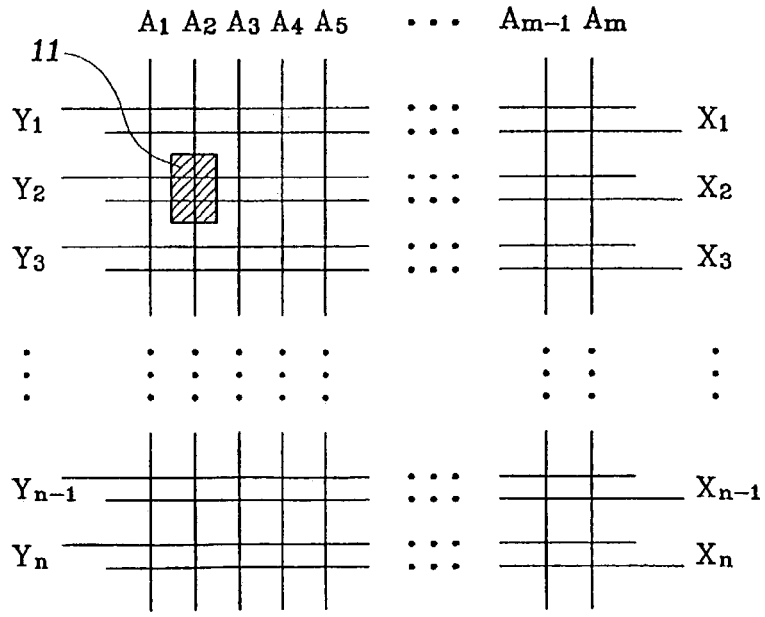
FIG. 2 is a schematic plane view of a PDP according to an embodiment of the present invention.
Figure 3:
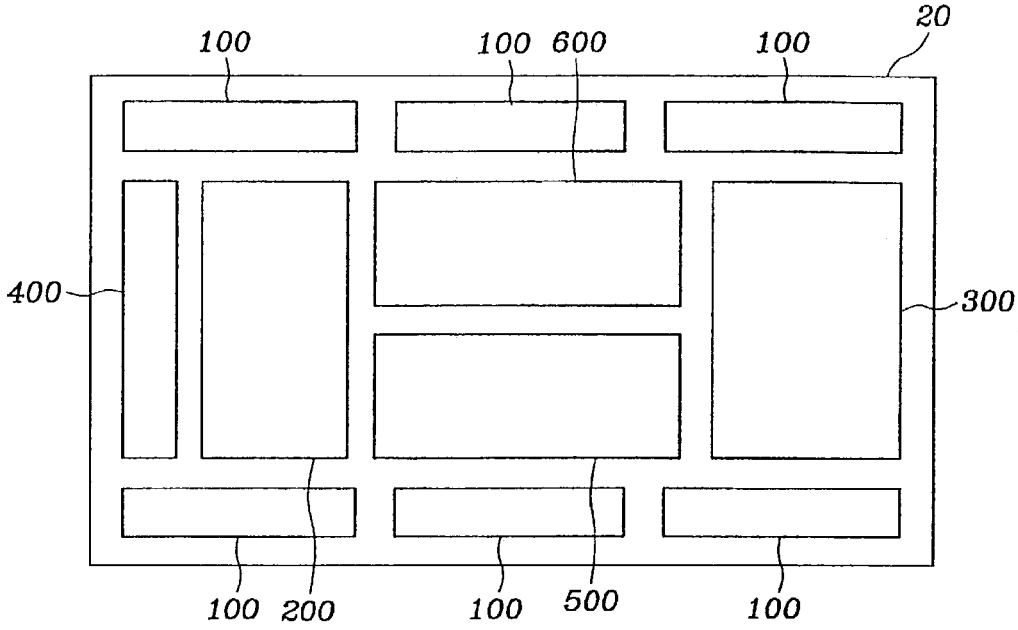
FIG. 3 is a schematic plane view of a sash base according to an embodiment of the present invention.

First, reference will be made to FIGS. 1, 2, and 3 to describe the schematic structure of a PDP apparatus according to an embodiment of the present invention. FIG. 1 is an exploded perspective of a PDP apparatus according to an embodiment of the present invention. FIG. 2 is a schematic plane view of a PDP according to an embodiment of the present invention. FIG. 3 is a schematic plane view of a sash base according to an embodiment of the present invention.

The PDP apparatus according to an embodiment of the present invention includes, as shown in FIG. 1, plasma panel 10, sash base 20, front case 30, and rear case 40. Sash base 20 is arranged on the side of plasma panel 10 opposite the image displaying side and is coupled to plasma panel 10. Front and rear cases 30 and 40 are arranged on the front side of plasma panel 10 and on the back side of sash base 20 and are coupled to plasma panel 10 and sash base 20, respectively, thereby completing a PDP apparatus.

Referring to FIG. 2, plasma panel 10 includes a plurality of address electrodes $A_1$ to $A_m$ arranged in columns, and a plurality of scan electrodes $Y_1$ to $Y_n$ and sustain electrodes $X_1$ to $X_n$ alternately arranged in rows. Sustain electrodes $X_1$ to $X_n$ are formed in correspondence to scan electrodes $Y_1$ to $Y_n$, respectively, with one terminal of each sustain electrode generally being coupled to one terminal of each scan electrode. Plasma panel 10 also includes a glass substrate on which sustain and scan electrodes $X_1$ to $X_n$ and $Y_1$ to $Y_n$ are arranged, and a glass substrate on which address electrodes $A_1$ to $A_m$ are arranged. The two glass substrates are disposed opposite to each other, with a discharge space formed between them such that scan electrodes $Y_1$ to $Y_n$ and sustain electrodes $X_1$ to $X_n$ are orthogonal to address electrodes $A_1$ to $A_m$. Here, a discharge space at each intersection of address electrodes $A_1$ to $A_m$ and sustain and scan electrodes $X_1$ to $X_n$ and $Y_1$ to $Y_n$ form discharge cell 11.

As shown in FIG. 3, boards 100 to 600 that are necessary for driving plasma panel 10 are formed on sash base 20. An address buffer board 100 is formed on the upper and lower parts of sash base 20 and may be composed of a single board or a plurality of boards. Although a dual-drive plasma display panel apparatus is exemplified in FIG. 3, address buffer board 100 for a single-drive plasma display panel apparatus is disposed on either of an upper or lower part of sash base 20. Address buffer board 100 receives an address drive control signal from picture-processing and logic board 500, and it applies a voltage for selecting discharge cells to be displayed to respective address electrodes $A_1$ to $A_m$.

Scan and sustain driver boards 200 and 300 are arranged on the left and right sides of sash base 20, respectively. Scan board 200 is coupled to scan electrodes $Y_1$ to $Y_n$ via scan buffer board 400. Scan buffer board 400 performs an operation necessary for the scanning of scan electrodes $Y_1$ to $Y_n$. Scan and sustain driver boards 200 and 300 receive a sustain discharge signal from picture-processing and logic board 500, and apply a sustain discharge pulse alternately to scan and sustain electrodes $Y_1$ to $Y_n$ and $X_1$ to $X_n$. A sustain discharge occurs on the discharge cells selected by the sustain discharge pulse application. Although scan and sustain driver boards 200 and 300 are separately described in FIG. 3, the two boards 200 and 300 can be implemented as a single board, and scan buffer board 400 can also be integrated with scan driver board 200.

Picture-processing and logic board 500 receives an externally applied picture signal to generate an address drive control signal and a sustain discharge signal, and applies the address drive control signal and the sustain discharge signal to address buffer board 100 and scan and sustain driver boards 200 and 300, respectively. Power supply board 600 supplies power necessary for driving the plasma display panel apparatus. Picture-processing and logic board 500 and power supply board 600 are arranged in the center of sash base 200.

Hereinafter, the structure and operation of address driver circuit 110 included in address driver board 100 will be described in detail with reference to FIGS. 4 and 5 and FIGS. 6A to 6H.

Figure 4:
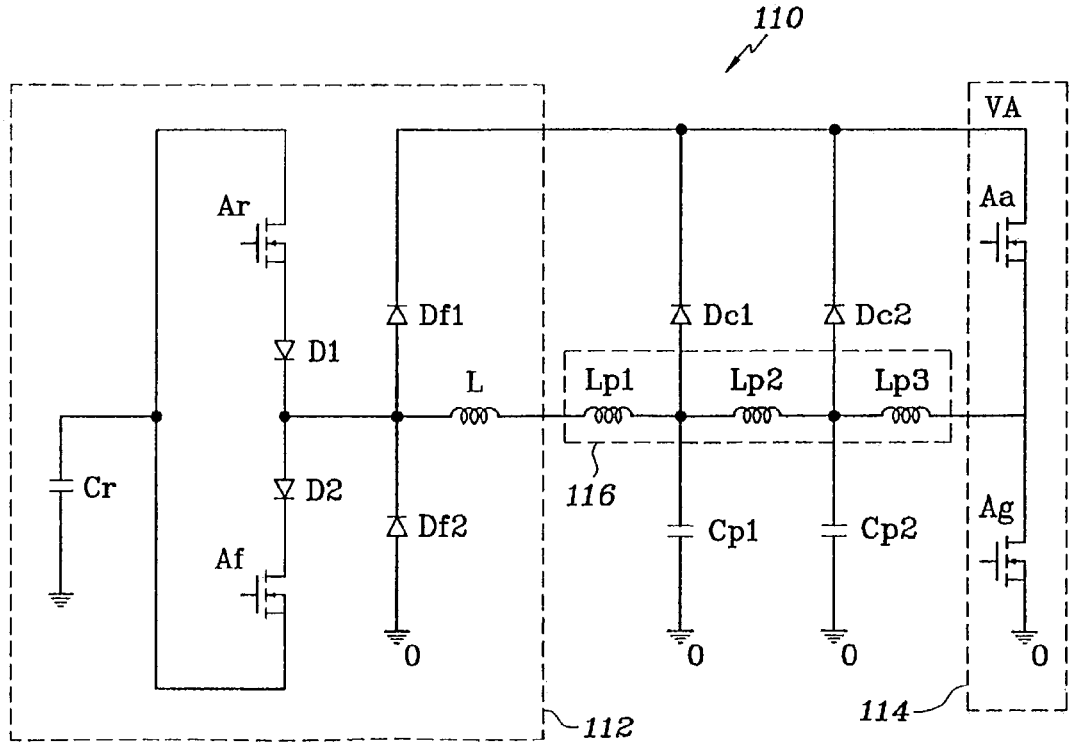
FIG. 4 is a schematic circuit diagram of an address driver circuit according to an embodiment of the present invention.
Figure 5:
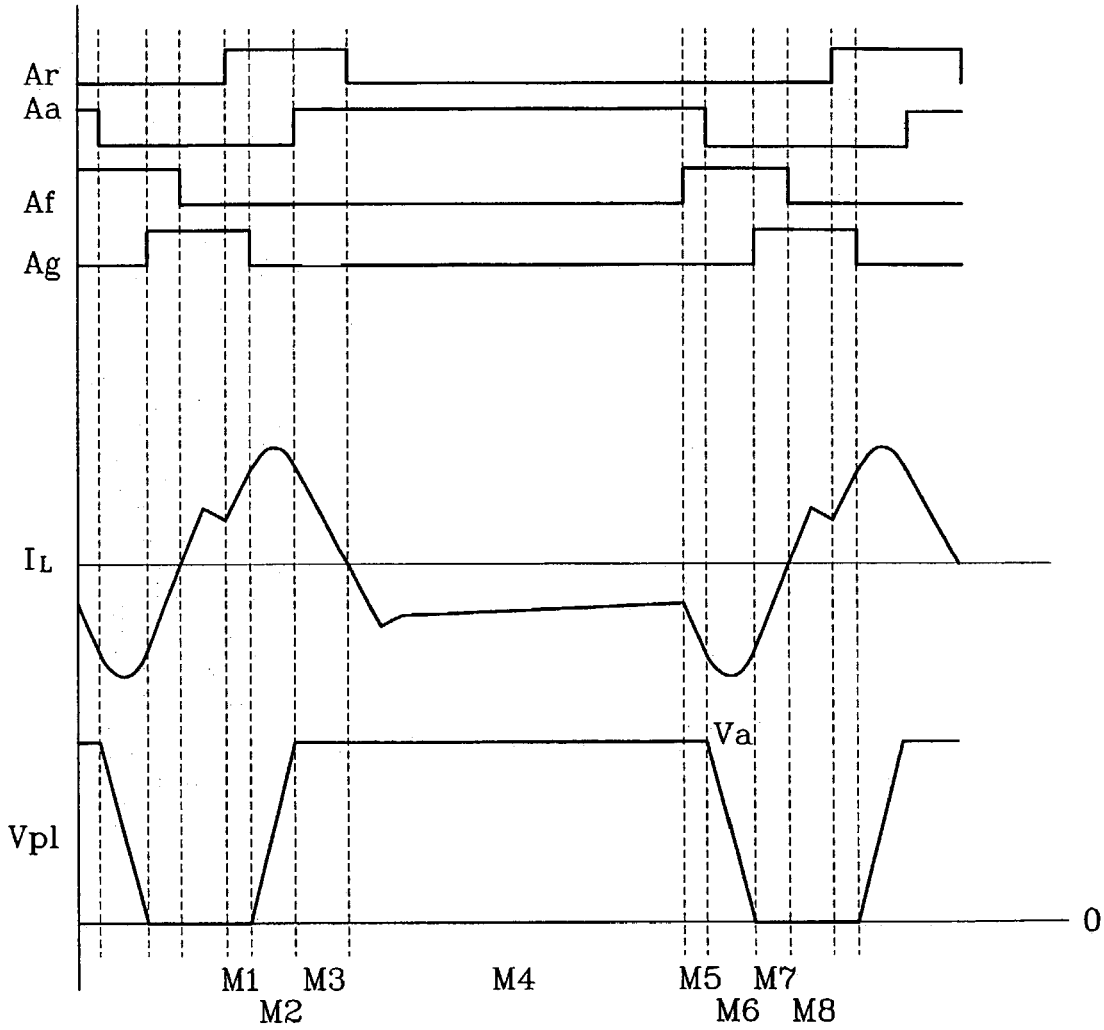
FIG. 5 is a timing diagram showing a driving operation of the address driver circuit according to an embodiment of the present invention.

FIG. 4 is a schematic circuit diagram of an address driver circuit according to an embodiment of the present invention. FIG. 5 is a timing diagram showing a driving operation of the address driver circuit according to an embodiment of the present invention. FIGS. 6A to 6H are illustrations showing a current path in each mode of the address driver circuit according to an embodiment of the present invention.

Address driver circuit 110 is coupled to address electrodes $A_1$ to $A_m$ via a plurality of address buffer ICs. Conductive output pattern 116 in which the address buffer ICs are coupled to address buffer board 100 functions as a parasitic inductance component. Address electrodes $A_1$ to $A_m$ formed on plasma panel 10 together with other electrodes $Y_1$ to $Y_n$ and $X_1$ to $X_n$ function as a capacitive load, which is generally called a "panel capacitor". Here, the voltage for addressing in address driver circuit 110 is applied only to the discharge cells selected by the address buffer ICs.

Expediently, in FIG. 4, the address buffer ICs are not shown but the parasitic inductance components are equivalently expressed as parasitic inductors $L_{p1}$, $L_{p2}$, and $L_{p3}$ on the assumption that address voltage $V_a$ is applied to two panel capacitors. A voltage high enough to select discharge cells with a voltage between both terminals of the panel capacitor is applied to the other terminal of the panel capacitor to which address voltage $V_a$ is applied. The voltage is assumed as ground voltage 0V in FIG. 4.

Address driver circuit 110 includes, as shown in FIG. 4, resonance circuit 112 and output circuit 114 coupled to each other with parasitic inductors $L_{p1}$, $L_{p2}$, and $L_{p3}$ disposed between them. Panel capacitors $C_{p1}$ and $C_{p2}$ are coupled between a contact of parasitic inductors $L_{p1}$ and $L_{p2}$ and ground terminal O and between a contact of parasitic inductors $L_{p2}$ and $L_{p3}$ and ground terminal O, respectively. Clamping diodes $D_{c1}$ and $D_{c2}$ are also coupled between contacts of parasitic inductors $L_{p1}$, $L_{p2}$, and $L_{p3}$ and a power source $V_A$ for supplying address voltage $V_a$, respectively. Clamping diodes $D_{c1}$ and $D_{c2}$ prevent the voltage of panel capacitors $C_{p1}$ and $C_{p2}$ from exceeding address voltage $V_a$ in an actual circuit.

Resonance circuit 112 includes power recovery capacitor $C_r$, switches $A_r$ and $A_f$, an inductor L, and freewheeling diodes $D_{f1}$ and $D_{f2}$. Output circuit 114 includes switches $A_a$ and $A_g$. Other active elements for making a freewheeling current flow to power source $V_A$ or ground terminal O can also be used instead of freewheeling diodes $D_{f1}$ and $D_{f2}$. Although switches $A_r$, $A_f$, $A_a$, and $A_g$ are denoted as MOSFETs in FIG. 4, they can be any switching elements so long as they perform the same or similar functions. Preferably, switches $A_r$, $A_f$, $A_a$, and $A_g$ have a body diode such as a pn junction separated structure of semiconductor ICs.

In resonance circuit 112, inductor L is coupled to parasitic inductor $L_{p1}$, and freewheeling diode $D_{f1}$ is coupled between inductor L and power source $V_A$, and freewheeling diode $D_{f2}$ is coupled between inductor L and ground terminal O, respectively. Switches $A_r$ and $A_f$ are coupled in parallel between inductor L and capacitor $C_r$, capacitor $C_r$ being coupled to ground terminal O. Capacitor $C_r$ acts as a power source for supplying voltage $V_a/2$ that amounts to approximately half address voltage $V_a$. Additionally, diodes $D_1$ and $D_2$ for interrupting a current flowing to the body diode of switches $A_r$ and $A_f$ can be formed between inductor L and capacitor $C_r$. Switches $A_r$ and $A_f$ act as means for charging and discharging panel capacitors $C_{p1}$ and $C_{p2}$.

In output circuit 114, switches $A_a$ and $A_g$ are coupled in series between power source $V_A$ and ground terminal O, and their contact is coupled to parasitic inductor $L_{p3}$. Switches $A_a$ and $A_g$ act as a means for injecting a current to inductor L and parasitic inductors $L_{p1}$, $L_{p2}$, and $L_{p3}$ prior to a charge/discharge of panel capacitors $C_{p1}$ and $C_{p2}$.

Hereinafter, the sequential operation of address driver circuit 110 according to an embodiment of the present invention will be described with reference to FIG. 5 and FIGS. 6A to 6H. The operation proceeds in the order of eight modes M1 to M8, all of which are activated by the manipulation of the switches $A_r$, $A_f$, $A_a$, and $A_g$. The phenomenon called "LC resonance" mentioned herein is not a continuous oscillation but a change in voltage and current caused by the combination of inductor L and panel capacitors $C_{p1}$ and $C_{p2}$ when switches $A_r$ and $A_f$ are turned on. Voltages $V_{p1}$ and $V_{p2}$ of panel capacitors $C_{p1}$ and $C_{p2}$ have a similar output waveform, excepting a difference caused by the effect of parasitic inductor $L_{p2}$. Accordingly, only voltage $V_{p1}$ of panel capacitor $C_{p1}$ is shown in FIG. 5.

In an embodiment of the present invention, it is assumed that before the start of the operation, capacitor $C_r$ is charged to voltage $V_a/2$ amounting to half the address voltage $V_a$ and that switch $A_g$ is turned on to form a freewheeling current flowing to a path of freewheeling diode $D_{f2}$, inductor L, parasitic inductors $L_{p1}$, $L_{p2}$, and $L_{p3}$, and switch $A_g$. The voltage of panel capacitor $C_{p1}$ and $C_{p2}$ is sustained at 0V.

Figure 6A:
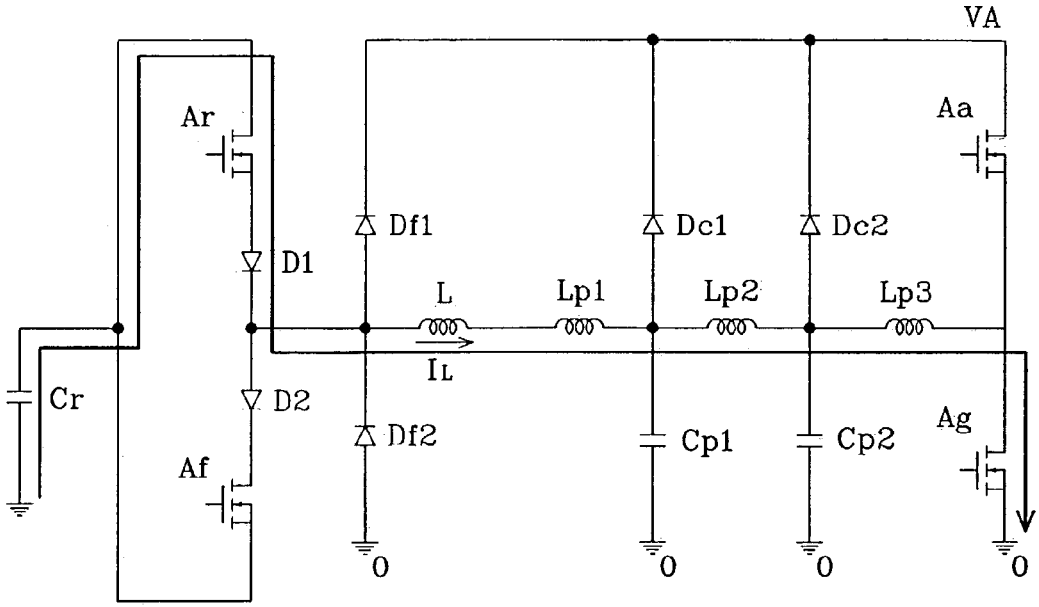
FIGS. 6A to 6H are illustrations showing a current path in each mode of the address driver circuit according to an embodiment of the present invention.

In mode 1 (M1), with switch $A_g$ on, switch $A_r$ is turned on, as shown in FIG. 5. Then, a current path that includes capacitor $C_r$, switch $A_r$, diode $D_1$, inductor L, parasitic inductors $L_{p1}$, $L_{p2}$, and $L_{p3}$, switch $A_g$, and ground terminal O is formed as shown in FIG. 6A so as to inject a current to inductor L and parasitic inductors $L_{p1}$, $L_{p2}$, and $L_{p3}$. Particularly, this current is injected while the freewheeling current is flowing prior to mode 1 (M1), so that current $I_L$ flowing to inductor L is linearly increased from a predetermined value.

Figure 6B:
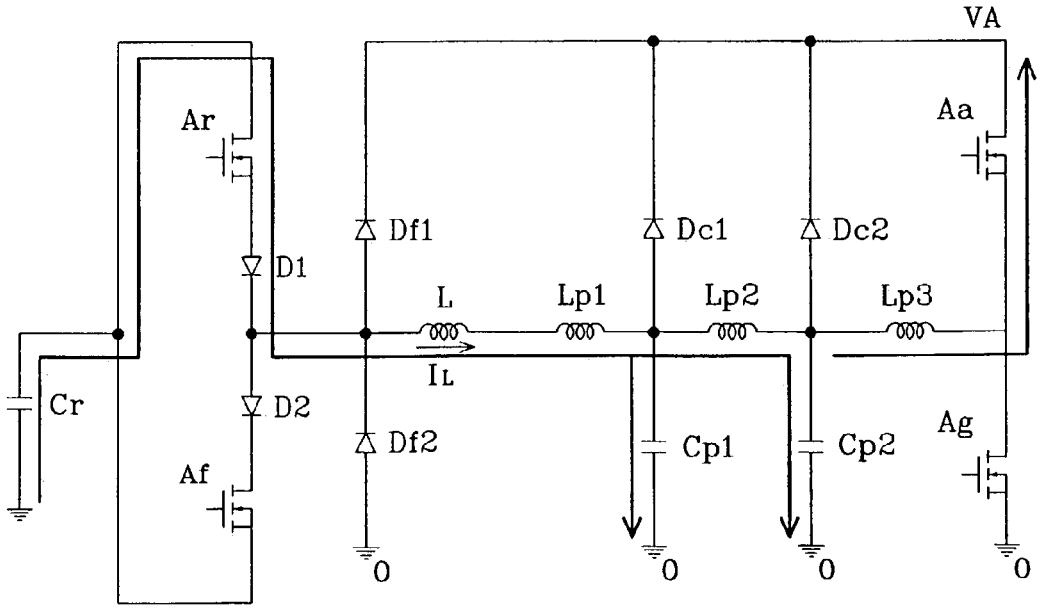

In mode 2 (M2), switch $A_g$ is turned off. Then, a current path that includes capacitor $C_r$, switch $A_r$, diode $D_1$, inductor L, parasitic inductor $L_{p1}$, panel capacitor $C_{p1}$ or parasitic inductor $L_{p2}$, and panel capacitor $C_{p2}$ is formed as shown in FIG. 6B to generate an LC resonance. The LC resonance current flows while a predetermined amount of current is flowing to inductor L and parasitic inductors $L_{p1}$ and $L_{p2}$, so that panel capacitors $C_{p1}$ and $C_{p2}$ are charged for a short time. In addition, an unwanted pulse rise does not occur as in the prior art, because parasitic inductors $L_{p1}$ and $L_{p2}$ are used to generate the LC resonance while a current is injected to parasitic inductors $L_{p1}$ and $L_{p2}$ beforehand. Voltages $V_{p1}$ and $V_{p2}$ of the panel capacitors are not increased to above address voltage $V_a$ due to the body diode of switch $A_a$ or clamping diodes $D_{c1}$ and $D_{c2}$. The current applied to parasitic inductor $L_{p3}$ is recovered to power source $V_A$ via the body diode of switch $A_a$.

Figure 6C:
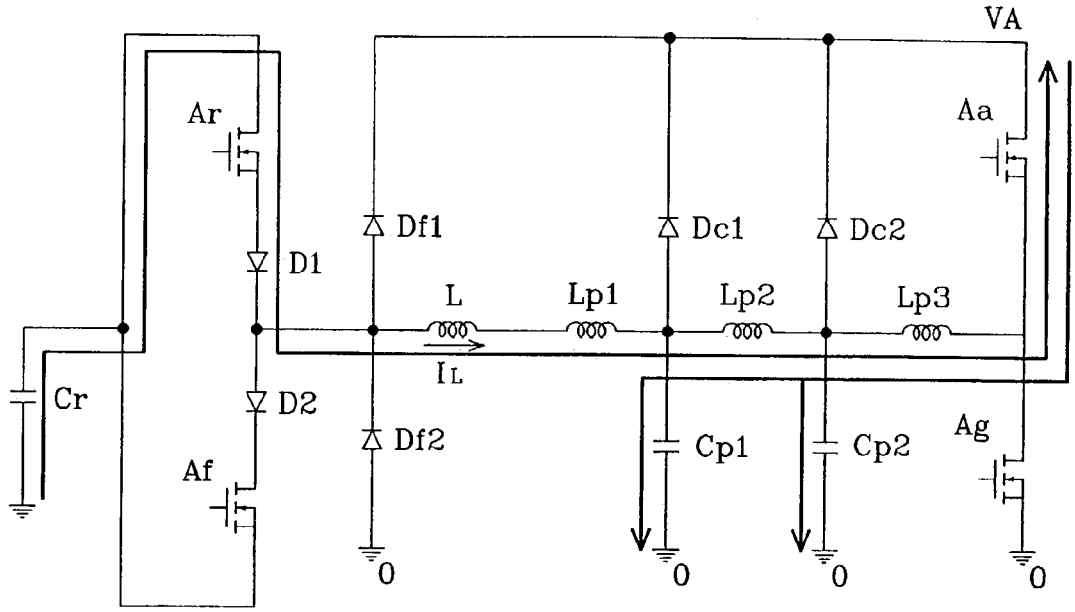

In mode 3 (M3), switch $A_a$ is turned on when voltages $V_{p1}$ and $V_{p2}$ of panel capacitors $C_{p1}$ and $C_{p2}$ are increased to address voltage $V_a$. As shown in FIG. 6C, voltages $V_{p1}$ and $V_{p2}$ of panel capacitors $C_{p1}$ and $C_{p2}$ are sustained at address voltage $V_a$, and current $I_L$ flowing to inductor L is recovered to power source $V_A$ via parasitic inductors $L_{p1}$, $L_{p2}$, and $L_{p3}$ and the body diode of switch $A_a$.

Figure 6D:
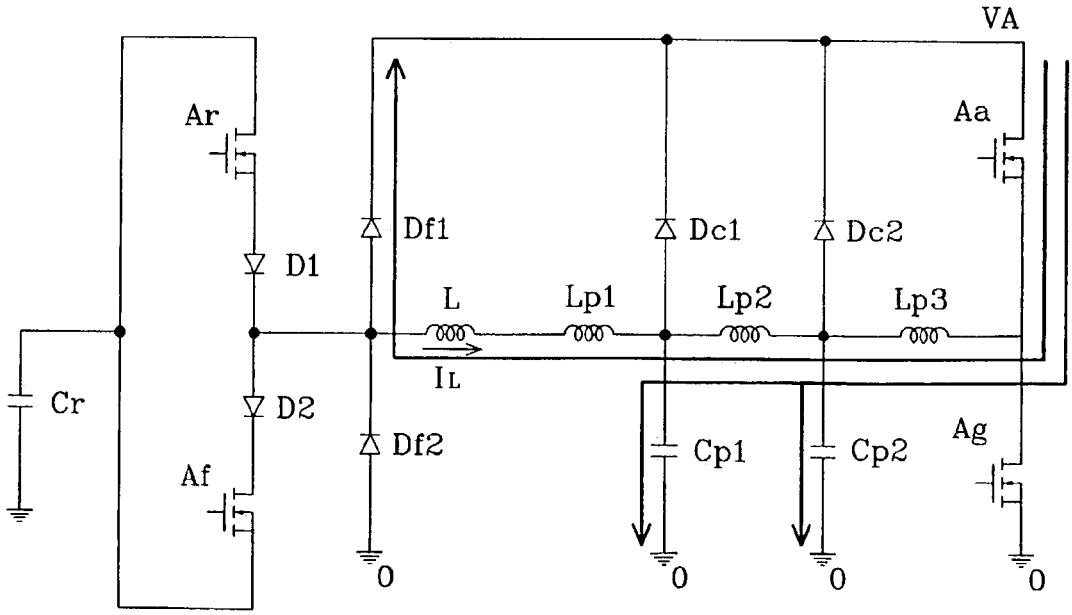

In mode 4 (M4), switch $A_r$ is turned off when current $I_L$ flowing to inductor L is recovered, as shown in FIG. 5. Then, a freewheeling current is generated on inductor L and parasitic inductors $L_{p1}$, $L_{p2}$, and $L_{p3}$ in the opposite direction of current in modes 1, 2, and 3 (M1, M2, and M3), as shown in FIG. 6D. The freewheeling current flows to power source $V_A$ via freewheeling diode $D_{f1}$. Due to this freewheeling current, the current is injected to inductor L and parasitic inductors $L_{p1}$, $L_{p2}$, and $L_{p3}$.

Figure 6E:
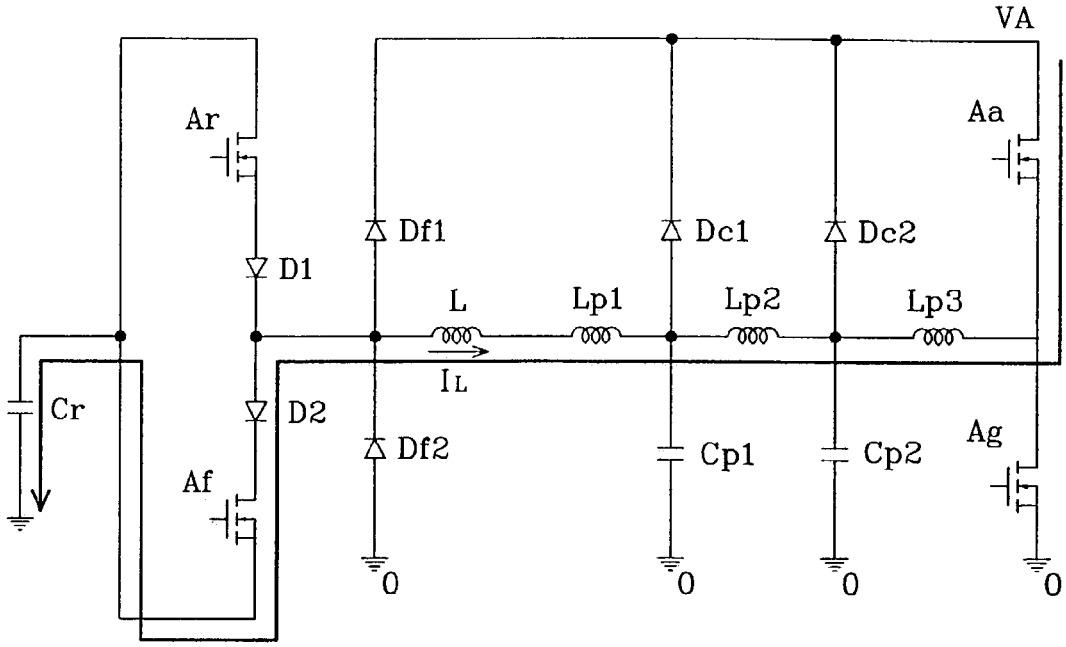

In mode 5 (M5), with switch $A_a$ on, switch $A_f$ is turned on. Then, a current path that includes power source $V_A$, switch $A_a$, parasitic inductors $L_{p3}$, $L_{p2}$, and $L_{p1}$, inductor L, diode $D_2$, switch $A_f$, and capacitor $C_r$ is formed as shown in FIG. 6E so as to inject a current in the opposite direction of the current in mode 1 (M1) to inductor L and parasitic inductors $L_{p1}$, $L_{p2}$, and $L_{p3}$. Particularly, this current is injected while the freewheeling current is flowing, so that the magnitude of current $I_L$ flowing to inductor L is linearly increased from a predetermined value.

Figure 6F:
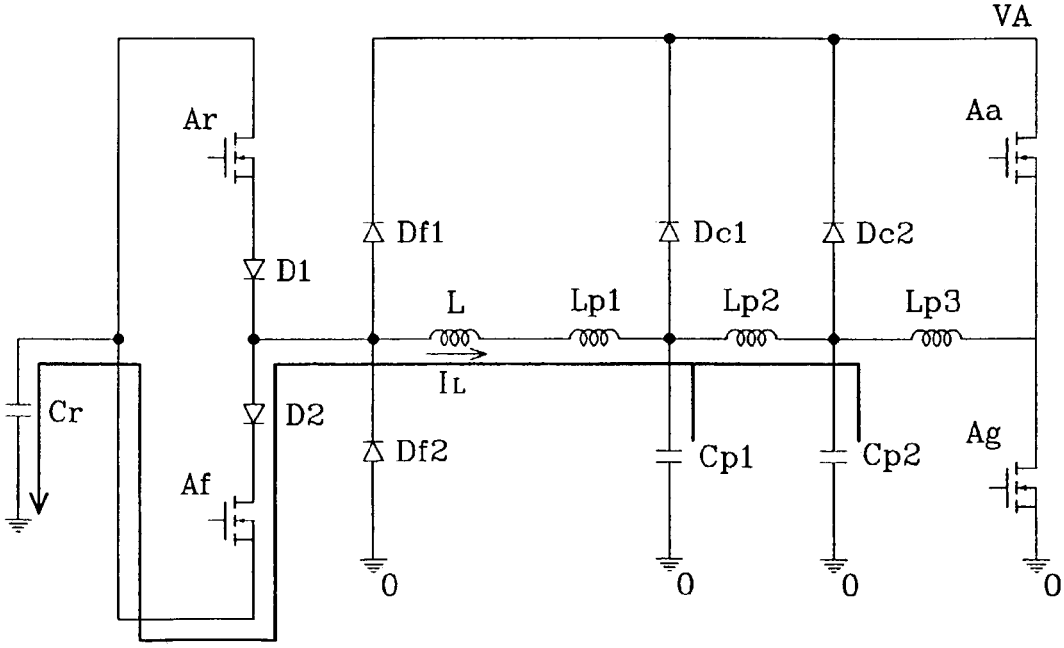

In mode 6 (M6), switch $A_a$ is turned off for a discharge of panel capacitors $C_{p1}$ and $C_{p2}$. Then, the energy charged in panel capacitors $C_{p1}$ and $C_{p2}$ is recovered to capacitor $C_r$ via parasitic inductor $L_{p1}$, inductor L, diode $D_2$, and switch $A_f$ due to the LC resonance caused by panel capacitors $C_{p1}$ and $C_{p2}$, inductor L and parasitic inductor $L_{p1}$ and/or $L_{p2}$, as shown in FIG. 6F. Here, as described in mode 2 (M2), the LC resonance current flows while a predetermined amount of current is flowing to inductor L and parasitic inductors $L_{p1}$ and $L_{p2}$, So that panel capacitors $C_{p1}$ and $C_{p2}$ are discharged for a short time. Also, an unwanted pulse rise does not occur as in the prior art, because parasitic inductors $L_{p1}$ and $L_{p2}$ are used to generate the LC resonance while a current is applied to parasitic inductors $L_{p1}$ and $L_{p2}$ beforehand.

Figure 6G:
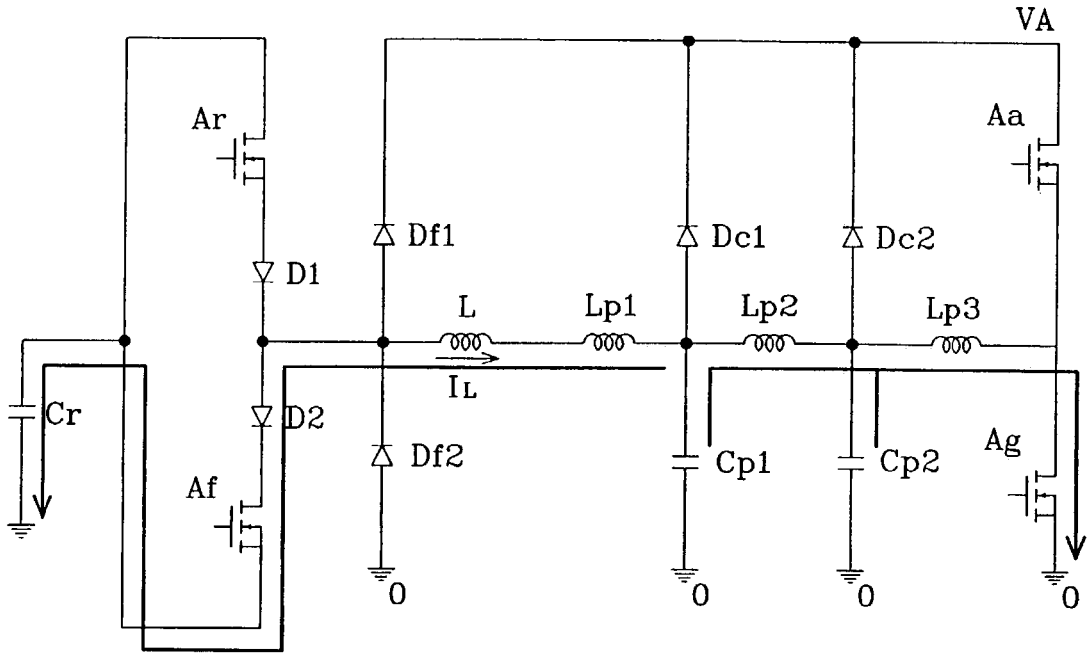

In mode 7 (M7), switch $A_g$ is turned on when voltages $V_{p1}$ and $V_{p2}$ of panel capacitors $C_{p1}$ and $C_{p2}$ are decreased to 0V. As shown in FIG. 6G, voltages $V_{p1}$ and $V_{p2}$ of panel capacitors $C_{p1}$ and $C_{p2}$ are sustained at 0V due to ground terminal O. Current $I_L$ flowing to inductor L is recovered to capacitor $C_r$ via a current path that includes the body diode of switch $A_g$, parasitic inductors $L_{p3}$, $L_{p2}$ and $L_{p1}$, inductor L, diode $D_2$, and switch $A_f$.

Figure 6H:
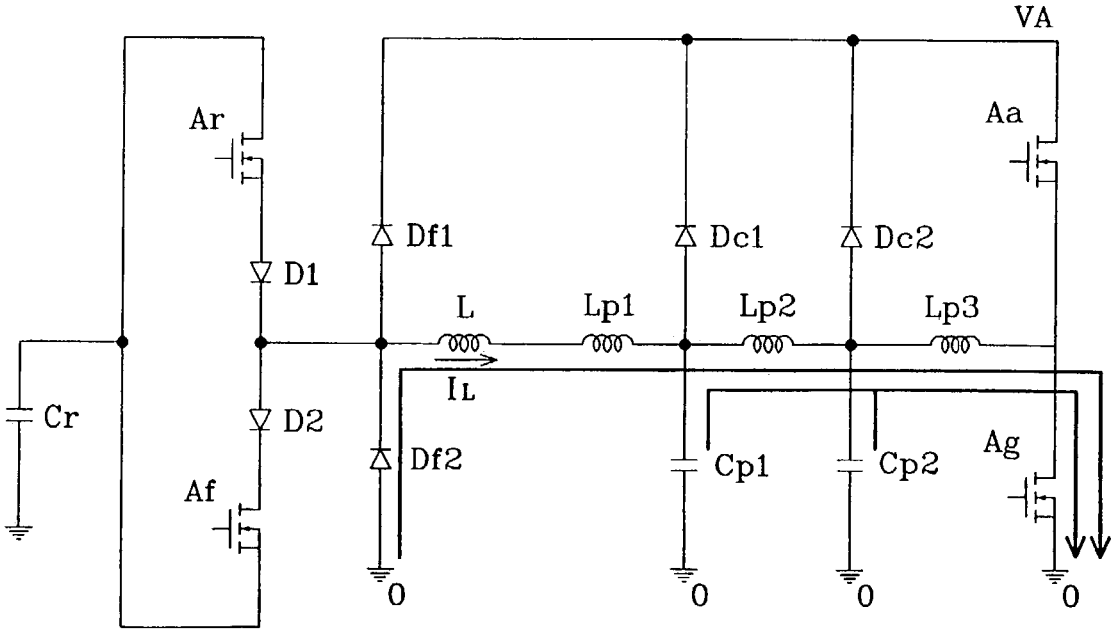

Referring to FIG. 5 and FIG. 6H, in mode 8 (M8), switch $A_f$ is turned off when current $I_L$ flowing to inductor L is recovered. Then, a freewheeling current is generated through freewheeling diode $D_{f2}$, inductor L, parasitic inductors $L_{p1}$, $L_{p2}$, and $L_{p3}$, and switch $A_g$. Namely, the freewheeling current is generated in the opposite direction of current in modes 4 to 7 (M4-M7). Due to this freewheeling current, the current is applied to inductor L and parasitic inductors $L_{p1}$, $L_{p2}$, and $LP_3$.

Subsequently, the procedures from mode 1 (M1) are repeated to continuously generate an address driving waveform for selecting discharge cells.

As described above, in an embodiment of the present invention, the current is previously applied to the inductor and the parasitic inductance components formed on the output pattern, and the inductor and the parasitic inductance components are used for LC resonance while the current is injected. It is therefore possible to eliminate a rise pulse that may otherwise occur when the panel capacitors are charged/discharged due to the parasitic inductance components. The charge/discharge time, i.e., the rise/drop time of the panel capacitor voltages can also be reduced, because the LC resonance occurs after the current is applied beforehand.

In an embodiment of the present invention, the current is applied to the inductor and the parasitic inductors using both a freewheeling current generated after a current recovery and a current generated from the voltage difference. Alternatively, either of the freewheeling current or the current generated from the voltage difference can be used. This embodiment of the present invention will be described in detail with reference to FIGS. 7, 8, and 9.

Figure 7:
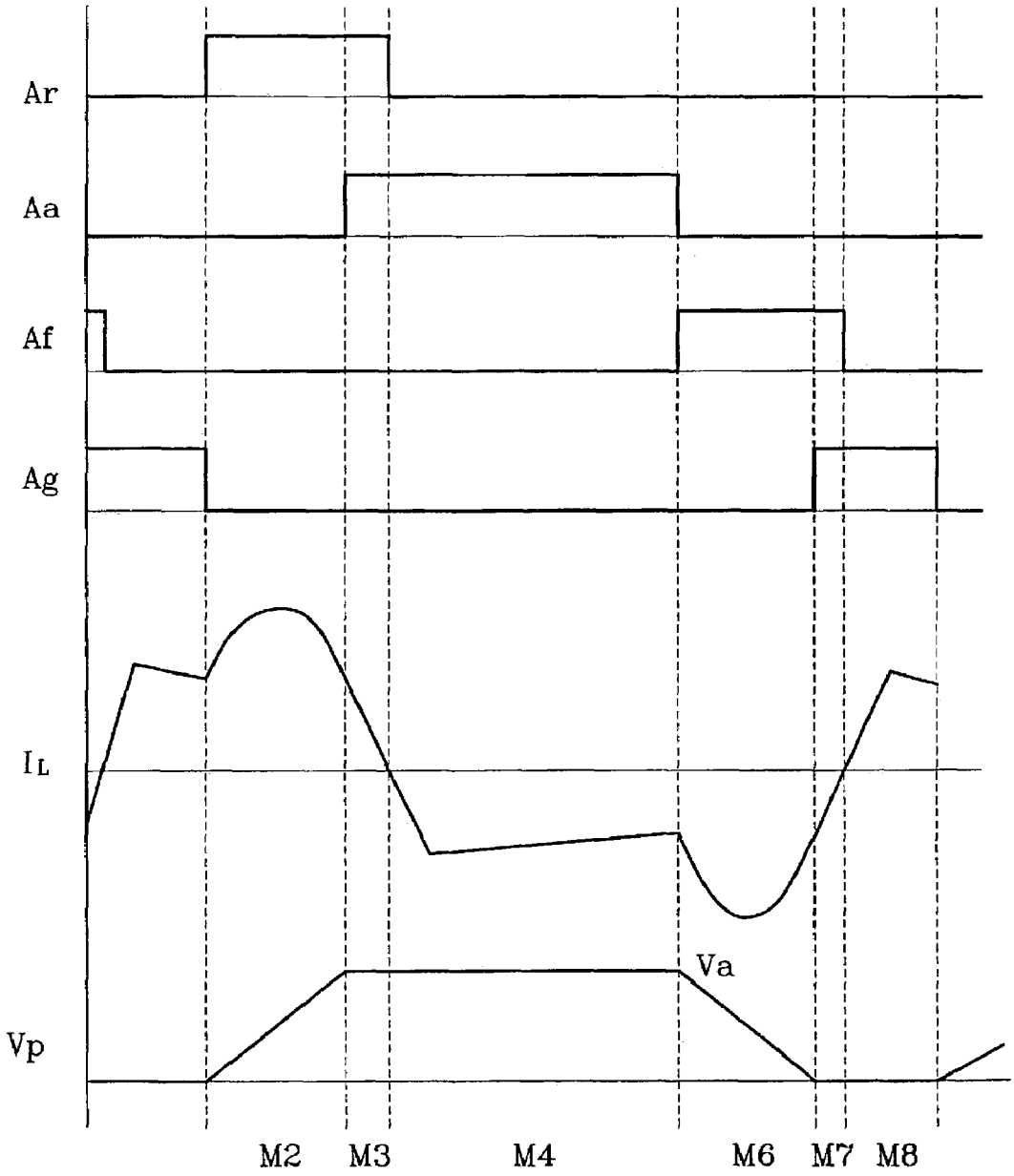
FIGS. 7 and 9 are timing diagrams showing a driving operation of an address driver circuit according to another embodiment of the present invention.
Figure 8:
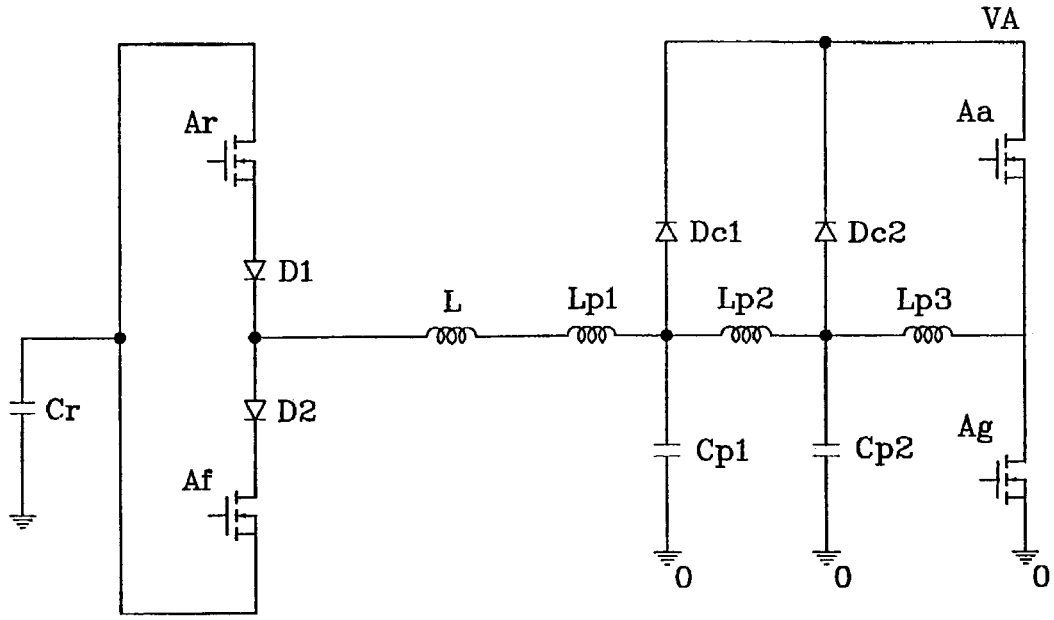
FIG. 8 is a schematic circuit diagram of an address driver circuit according to another embodiment of the present invention.
Figure 9:
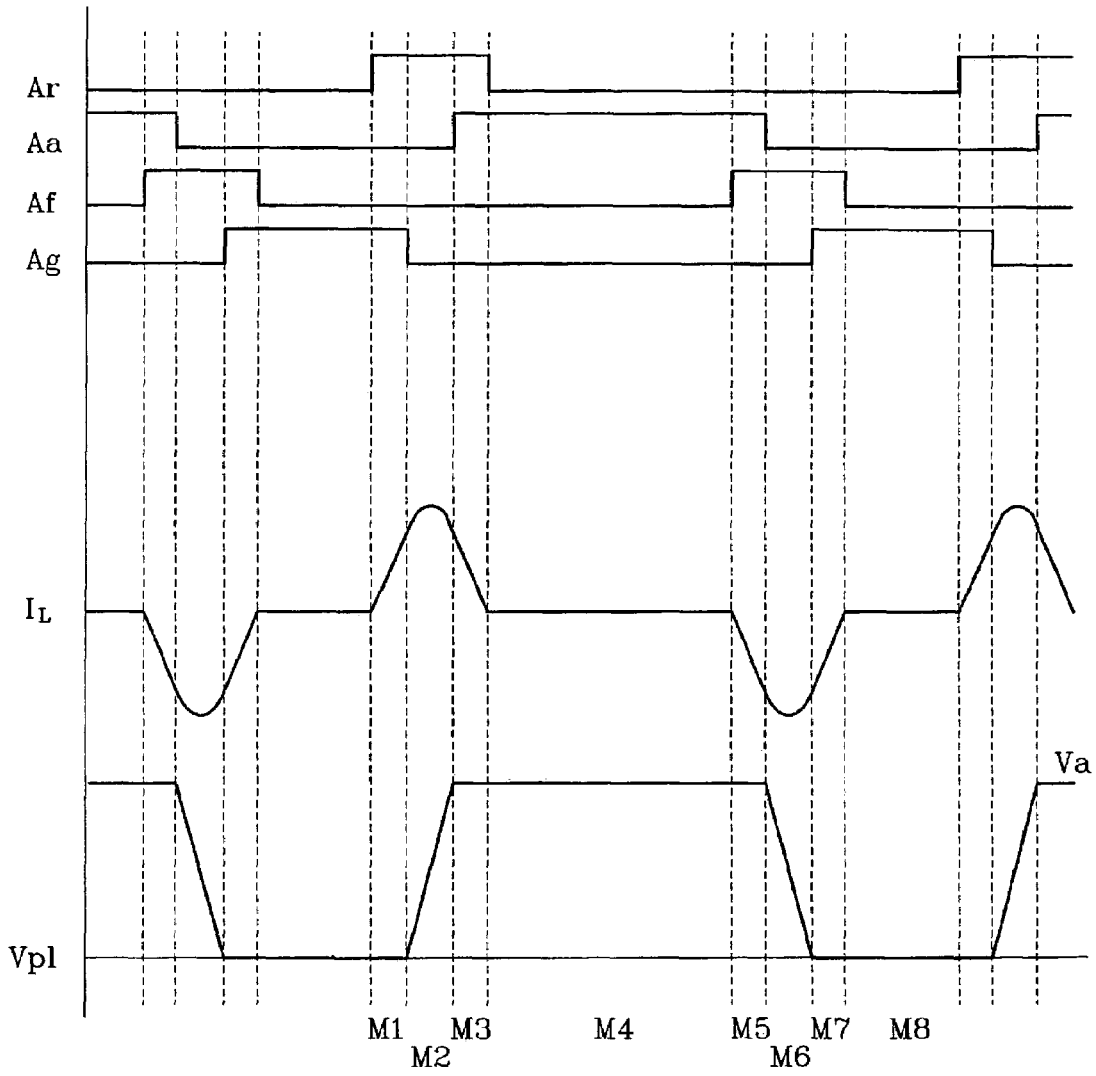

FIGS. 7 and 9 are timing diagrams showing a driving operation of an address driver circuit according to another embodiment of the present invention, and FIG. 8 is a schematic circuit diagram of the address driver circuit according to another embodiment of the present invention.

Referring to FIG. 7, the driving timing according to another embodiment of the present invention is the same as that shown in FIG. 5, except that modes 1 and 5 (M1 and M5) are excluded. More specifically, the current is injected to the inductor and the parasitic inductors only with a freewheeling current generated in modes 4 and 8 (M4 and M8), and the LC resonance is caused while the freewheeling current is flowing, thereby charging/discharging panel capacitors $C_{p1}$ and $C_{p2}$.

In an embodiment shown in FIGS. 8 and 9, instead of the freewheeling current, the voltage difference between power source $V_A$ or the ground terminal and capacitor $C_r$ is used to generate a current applied to the inductor and the parasitic inductors. Accordingly, as shown in FIG. 8, freewheeling diodes $D_{f1}$ and $D_{f2}$ can be eliminated in the address driver circuit according to this embodiment. As shown in FIG. 9, the driving timing according to this embodiment is the same as that shown in FIG. 5, except that the freewheeling current does not flow to inductor L.

Hereinafter, the structure of address buffer board 100 having address driver circuit 110 according to an embodiment of the present invention will be described in detail with reference to FIGS. 10 and 11.

Figure 10:
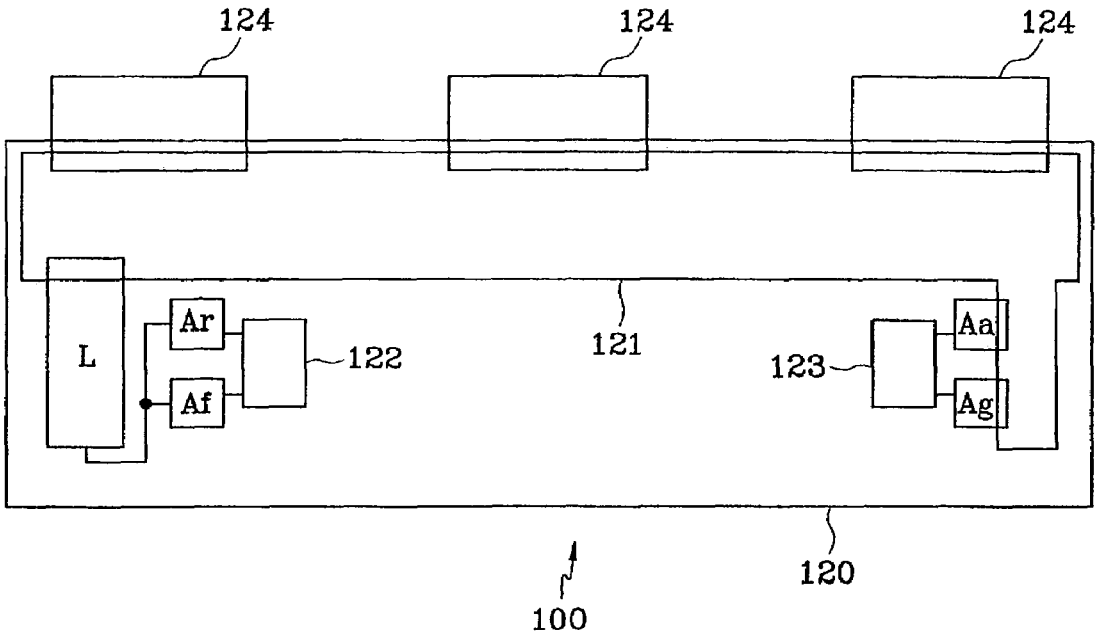
FIGS. 10 and 11 are schematic plane views of an address buffer board according to an embodiment of the present invention.
Figure 11:
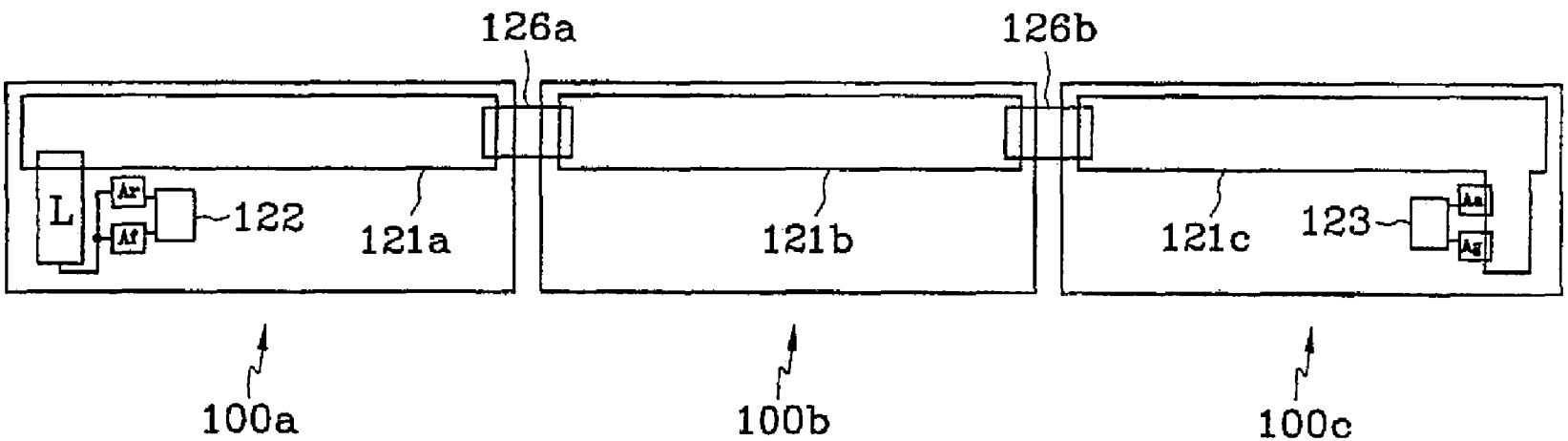

FIGS. 10 and 11 are schematic plane views of the address buffer board according to an embodiment of the present invention.

As shown in FIG. 10, inductor L is disposed on the left side of printed circuit board 120 of address buffer board 100, and switches $A_r$ and $A_f$ are disposed on the right side to inductor L and coupled to inductor L. Inductor L is coupled to switches $A_a$ and $A_g$ via an output pattern 121 formed on printed circuit board 120. Drivers 122 and 123 for driving switches $A_r$ and $A_f$ and switches $A_a$ and $A_g$, respectively, are formed around these switches. Output pattern 121 is formed in the transverse direction on printed circuit board 120 and actually functions as parasitic inductors $L_{p1}$, $L_{p2}$, and $L_{p3}$. Output pattern 121 is generally formed on the reverse side of printed circuit board 120, but in FIG. 10, it is expediently shown on the upper side of the printed circuit board.

Flexible printed circuit (FPC) board 124 is coupled to printed circuit board 120 of address buffer board 100, and also to address electrodes $A_1$ to $A_m$. The above-stated address buffer ICs are mounted on FPC board 124 in the form of chips. This is called a "chip on flexible (COF) board system". Alternatively, the address buffer ICs may be mounted directly on the printed circuit board of address buffer board 100. This is called a "chip on board (COB) system".

Although inductor L is formed on the left side of address buffer board 100 in FIG. 10, it may also be formed on the right side of address buffer board 100. In this case, the circuit arrangement is the reverse of the structure shown in FIG. 10, and it will not be described in detail. Address buffer board 100 arranged on the upper or lower part of sash base 20 can be composed of a single board or a plurality of boards.

In the case where plural address buffer boards 100 are formed, address driver circuit 110 can be mounted on individual address buffer boards 100. Alternatively, as shown in FIG. 11, inductor L and switches $A_r$ and $A_f$ are formed on left-handed address buffer board 100*a* among plural address buffer boards 100, and switches $A_a$ and $A_g$ are formed on right-hand address buffer board 100*c*. Connectors 126*a* and 126*b* are coupled between output patterns 121*a* and 121*b* of address buffer boards 100*a* and 100*b* and between output patterns 121*b* and 121*c* of address buffer boards 100*b* and 100*c*, respectively. With this structure, inductor L is coupled to switches $A_a$ and $A_g$ via output patterns 121*a*, 121*b*, and 121*c* of address buffer boards 100*a*, 100*b*, and 100*c*.

For a dual-drive PDP apparatus, separate address driver circuit 110 may be mounted on the upper and lower address driver boards. Alternatively, inductor L and switches $A_r$ and $A_f$ are mounted on either one of the upper or lower address driver boards 100, and switches $A_a$ and $A_g$ are mounted on the other address driver board 100. As described previously, inductor L and switches $A_r$, $A_f$, $A_a$, and $A_g$ are arranged such that inductor L is coupled to switches $A_a$ and $A_g$ via the output pattern of upper and lower address buffer boards 100.

With inductor L and switches $A_r$, $A_f$, $A_a$, and $A_g$ arranged as illustrated in FIGS. 10 and 11, the current is also injected to parasitic inductors $L_{p1}$, $L_{p2}$, and $L_{p3}$ formed on output pattern 121 when it is injected to inductor L.

Although embodiments of the present invention are applied to the address buffer board, they can also be applied to the output pattern formed on the scan and sustain driver boards coupled to the scan and sustain electrodes as well as the address buffer board.

As described above, the present invention minimizes the effect of the parasitic inductance component formed on a current path between the address driving ICs. Furthermore, the present invention reduces the required charge or discharge time, because the LC resonance occurs while the current is already applied.

While this invention has been described in connection with what is considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for driving a plasma display panel, which applies a voltage to a panel capacitor that is coupled on a conductive pattern formed lengthwise, the apparatus comprising:

an inductor coupled to one terminal of the conductive pattern;

a first switch and a second switch coupled to the inductor, and operated to charge and discharge the panel capacitor to a first voltage and a second voltage, respectively;

a third switch coupled between an other terminal of the conductive pattern and a first power source for supplying the first voltage, and operated to generate a current of a first direction flowing to the conductive pattern and the inductor;

a fourth switch coupled between the other terminal of the conductive pattern and a second power source for supplying the second voltage, and operated to generate a current of a second direction flowing to the inductor and the conductive pattern, the second direction being opposite to the first direction; and a power line coupled to the first switch and the second switch and supplying a third voltage having a value between the first voltage and the second voltage, wherein the panel capacitor is discharged to the second voltage by a resonance between the inductor and the panel capacitor while the current of the first direction is flowing, and the panel capacitor is charged to the first voltage by a resonance between the inductor and the panel capacitor while the current of the second direction is flowing.

2. The apparatus as claimed in claim 1, further comprising:

a first diode coupled between the inductor and the first power source; and a second diode coupled between the second power source and the inductor, wherein the current of the first direction includes a first freewheeling current flowing from the conductive pattern and the inductor via the first diode, and the current of the second direction includes a second freewheeling current flowing from the second diode via the inductor and the conductive pattern.

3. The apparatus as claimed in claim 1, wherein the current of the first direction includes a current flowing from the first power source to the power line via the conductive pattern and the inductor by the operation of the second switch, and the current of the second direction includes a current flowing from the power line to the second power source via the inductor and the conductive pattern by the operation of the first switch.

4. The apparatus as claimed in claim 1, wherein the resonance for charging or discharging the panel capacitor further includes a resonance formed between a parasitic inductance component present in the conductive pattern and the panel capacitor.

5. An apparatus for driving a plasma display panel, which receives a first voltage and a second voltage from a first power source and a second power source, respectively, and applies a voltage to a panel capacitor coupled on a conductive pattern formed lengthwise, the apparatus comprising:

a power line for supplying a third voltage having a value between the first and second voltages;

an inductor having one terminal thereof coupled to one terminal of the conductive pattern;

a first current path formed to make a current of a first direction flow to the inductor and the conductive pattern, while an other terminal of the conductive pattern is coupled to the second power source;

a second current path formed to generate a resonance between the inductor and the panel capacitor while the current of the first direction is flowing, thereby charging the panel capacitor to the first voltage;

a third current path formed to recover the current of the first direction remaining in the inductor and the conductive pattern, while the panel capacitor is sustained at the first voltage;

a fourth current path formed to make a current of a second direction flow to the conductive pattern and the inductor, while the other terminal of the conductive pattern is coupled to the first power source, the second direction being opposite to the first direction;

a fifth current path formed to generate a resonance between the inductor and the panel capacitor while the current of the second direction is flowing, thereby discharging the panel capacitor to the second voltage; and a sixth current path formed to recover the current of the second direction remaining in the inductor and the conductive pattern, while the panel capacitor is sustained at the second voltage.

6. The apparatus as claimed in claim 5, further comprising:

an active element coupled between the second power source and an other terminal of the inductor, wherein the first current path includes a freewheeling current path formed from the active element to the second power source via the inductor and the conductive pattern.

7. The apparatus as claimed in claim 5, wherein the first current path includes a current path formed from the power line to the second power source via the inductor and the conductive pattern.

8. The apparatus as claimed in claim 5, further comprising:

an active element coupled between the other terminal of the inductor and the first power source, wherein the fourth current path includes a freewheeling current path formed from the first power source to the active element via the conductive pattern and the inductor.

9. The apparatus as claimed in claim 5, wherein the fourth current path includes a current path formed from the first power source to the power line via the conductive pattern and the inductor.

10. The apparatus as claimed in claim 5, further comprising:

a first switch coupled between the first power source and the other terminal of the conductive pattern, wherein the fourth current path is formed when the first switch is turned on, and the third current path is formed through a body diode of the first switch.

11. The apparatus as claimed in claim 10, further comprising:

a second switch coupled between the power line and the inductor, wherein the fifth current path is formed when the second switch is turned on and the first switch is turned off.

12. The apparatus as claimed in claim 10, wherein the panel capacitor is sustained at the first voltage when the first switch is turned on.

13. The apparatus as claimed in claim 5, further comprising:

a first switch coupled between the second power source and the other terminal of the conductive pattern, wherein the first current path is formed when the first switch is turned on, and the sixth current path is formed through a body diode of the first switch.

14. The apparatus as claimed in claim 13, further comprising:

a second switch coupled between the power line and the inductor, wherein the second current path is formed when the second switch is turned on and the first switch is turned off.

15. The apparatus as claimed in claim 13, wherein the panel capacitor is sustained at the second voltage when the first switch is turned on.

16. A method for driving a plasma display panel, which receives a first voltage and a second voltage from a first power source and a second power source, respectively, and applies a voltage to a panel capacitor coupled on a conductive pattern formed lengthwise, the method comprising:

(a) injecting a current of a first direction to the conductive pattern and an inductor coupled to one terminal of the conductive pattern;

(b) generating a resonance between the panel capacitor and the inductor to charge the panel capacitor to the first voltage, while the current of the first direction is flowing to the conductive pattern and the inductor;

(c) recovering the current remaining in the inductor and the conductive pattern while sustaining the panel capacitor at the first voltage;

(d) applying a current of a second direction to the inductor and the conductive pattern, the second direction being opposite to the first direction;

(e) generating a resonance between the panel capacitor and the inductor to discharge the panel capacitor to the second voltage, while the current of the second direction is flowing to the inductor and the conductive pattern; and (f) recovering the current remaining in the inductor and the conductive pattern while sustaining the panel capacitor at the second voltage.

17. The method as claimed in claim 16, wherein the current of the first direction includes a freewheeling current generated when the current remaining in the inductor and the conductive pattern is recovered after the panel capacitor is discharged to the second voltage, and the current of the second direction includes a freewheeling current generated when the current remaining in the inductor and the conductive pattern is recovered after the panel capacitor is charged to the first voltage.

18. The method as claimed in claim 16, wherein the current of the first direction and the current of the second direction each include a current generated by a voltage difference.

19. The method as claimed in claim 16, wherein a resonance is also generated between a parasitic inductance component present in the conductive pattern and the panel capacitor, when the resonance is generated between the inductor and the panel capacitor.

20. A plasma display panel apparatus comprising:

a plasma panel including a plurality of address electrodes, a plurality of scan and sustain electrodes arranged in pairs and parallel with one another, and a panel capacitor formed among the address, scan, and sustain electrodes; and a driver circuit for supplying a driving signal to the scan, sustain, and address electrodes, the driver circuit including:

a conductive pattern formed lengthwise and coupled to one of the address, scan, and sustain electrodes;

an inductor coupled to one terminal of the conductive pattern;

a first current injector coupled to an other terminal of the conductive pattern and injecting a current of a first direction to the inductor and the conductive pattern while sustaining the panel capacitor at a first voltage;

a discharger for generating a resonance between the inductor and the panel capacitor to discharge the panel capacitor to a second voltage, while the current of the first direction is flowing to the inductor and the conductive pattern by way of the first current injector;

a second current injector for injecting a current of a second direction to the inductor and the conductive pattern while sustaining the panel capacitor at a second voltage, the second direction being opposite to the first direction; and a charger for generating a resonance between the inductor and the panel capacitor to charge the panel capacitor to the first voltage, while the current of the second direction is flowing to the inductor and the conductive pattern by way of the second current injecting means.

21. The plasma display panel apparatus as claimed in claim 20, further comprising a power line for supplying a voltage having a value between the first voltage and the second voltage to the charger and discharger.

22. The plasma display panel apparatus as claimed in claim 21, wherein the current of the first direction includes a current formed by a voltage difference between a first power source for supplying the first voltage and the power line, and the current of the second direction includes a current formed by a voltage difference between a second power source for supplying the second voltage and the power line.

23. The plasma display panel apparatus as claimed in claim 20, wherein the current of the first direction and the current of the second direction injected by the first current injector and the second current injector are recovered after the panel capacitor is discharged and charged, respectively.

24. The plasma display panel apparatus as claimed in claim 23, wherein the current of the first direction includes a freewheeling current generated after the current of the second direction is recovered, and the current of the second direction includes a freewheeling current generated after the current of the first direction is recovered.

25. The plasma display panel apparatus as claimed in claim 20, wherein the resonance in the charging or discharging means further includes a resonance formed between a parasitic inductance component present in the conductive pattern and the panel capacitor.

26. A plasma display panel apparatus comprising:

a plasma panel including a first substrate, a plurality of address electrodes formed on the first substrate, a second substrate opposite to the first substrate, and a plurality of scan and sustain electrodes formed on the second substrate; and a sash base opposite to the plasma display panel and including an address buffer board for transferring a driving signal to the address electrodes, and a scan and sustain driver board for transferring the driving signal to the scan and sustain electrodes, the address buffer board including:

a printed circuit board;

an output pattern formed lengthwise on one side of the printed circuit board and coupled to the address electrodes;

an inductor formed on the printed circuit board and coupled to one terminal of the output pattern;

a first switch and a second switch formed on the printed circuit board and coupled to the inductor; and a third switch and a fourth switch formed on the printed circuit board and coupled to an other terminal of the output pattern.

27. The plasma display panel apparatus as claimed in claim 26, wherein the address buffer board includes a plurality of boards each including the printed circuit board, the output pattern, the inductor, the first switch, the second switch, the third switch and the fourth switch.

28. The plasma display panel apparatus as claimed in claim 26, wherein the address buffer board includes a plurality of boards coupled in series to one another and each including the printed circuit board and the output pattern, one of the plurality of boards further including the inductor and the first and second switches, another one of the plurality of boards further including the third and fourth switches.

29. The plasma display panel apparatus as claimed in claim 26, further comprising a flexible circuit board coupling the output pattern to the address electrodes.

30. The plasma display panel apparatus as claimed in claim 29, further comprising an address buffer IC formed on the flexible circuit board and determining the address electrodes to be selected.

31. The plasma display panel apparatus as claimed in claim 29, further comprising an address buffer IC formed on the address buffer board and determining the address electrodes to be selected.

* * * * *